US010962266B2

(12) United States Patent
Zha et al.

(10) Patent No.: US 10,962,266 B2
(45) Date of Patent: Mar. 30, 2021

(54) COOLING SYSTEM

(71) Applicant: Heatcraft Refrigeration Products LLC, Stone Mountain, GA (US)

(72) Inventors: Shitong Zha, Snellville, GA (US); Michael Hollister, Atlanta, GA (US)

(73) Assignee: Heatcraft Refrigeration Products, LLC, Stone Mountain, GA (US)

( * ) Notice: Subject to any disclaimer, the term of this patent is extended or adjusted under 35 U.S.C. 154(b) by 116 days.

(21) Appl. No.: 16/169,438

(22) Filed: Oct. 24, 2018

(65) Prior Publication Data

US 2020/0132351 A1 Apr. 30, 2020

(51) Int. Cl.

| | |
|---|---|
| ***F25B 40/02*** | (2006.01) |
| ***F25B 47/02*** | (2006.01) |
| ***F25B 39/04*** | (2006.01) |
| ***F25B 41/06*** | (2006.01) |
| ***F25B 43/02*** | (2006.01) |

(52) U.S. Cl.

CPC ..... *F25B 47/022* (2013.01); *F25B 39/04* (2013.01); *F25B 40/02* (2013.01); *F25B 41/062* (2013.01); *F25B 43/02* (2013.01); *F25B 2347/021* (2013.01); *F25B 2400/053* (2013.01)

(58) Field of Classification Search

CPC ..... F25B 40/02; F25B 47/02; F25B 2347/02; F25B 1/10

See application file for complete search history.

(56) References Cited

U.S. PATENT DOCUMENTS

| | | | | |
|---|---|---|---|---|
| 5,174,123 | A * | 12/1992 | Erickson | F25B 1/047 62/113 |
| 2010/0050672 | A1* | 3/2010 | Kurihara | F25B 9/008 62/190 |
| 2011/0023514 | A1 | 2/2011 | Mitra et al. | |
| 2011/0030407 | A1* | 2/2011 | Yoshimi | F25B 47/025 62/324.5 |
| 2018/0252441 | A1 | 9/2018 | Zha et al. | |

FOREIGN PATENT DOCUMENTS

| | | | |
|---|---|---|---|
| JP | 2010127563 | A | 6/2010 |

OTHER PUBLICATIONS

European Patent Office, the Extended European Search Report, Application No. 19199464.9, dated Apr. 22, 2020, 5 pages.

* cited by examiner

*Primary Examiner* — David J Teitelbaum
(74) *Attorney, Agent, or Firm* — Baker Botts L.L.P.

(57) ABSTRACT

An apparatus includes a high side heat exchanger, a subcooler heat exchanger, a flash tank, a load, and a compressor. The high side heat exchanger removes heat from a refrigerant. The subcooler heat exchanger receives the refrigerant. The flash tank stores the refrigerant. During a first mode of operation, the load uses the refrigerant to cool a space proximate the load and the compressor compresses the refrigerant. During a second mode of operation, the subcooler heat exchanger receives the refrigerant from the flash tank, transfers heat from the refrigerant from the high side heat exchanger to the refrigerant from the flash tank and directs the refrigerant from the flash tank to the compressor. During the second mode of operation, the compressor compresses the refrigerant from the subcooler heat exchanger and directs the compressed refrigerant to the load to defrost the load.

18 Claims, 7 Drawing Sheets

COOLING SYSTEM

TECHNICAL FIELD

This disclosure relates generally to a cooling system.

BACKGROUND

Cooling systems may cycle a refrigerant to cool various spaces. For example, a refrigeration system may cycle refrigerant to cool spaces near or around refrigeration loads. After the refrigerant absorbs heat, it can be cycled back to the refrigeration loads to defrost the refrigeration loads.

SUMMARY

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a low temperature load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle typically maintain three low temperature loads in a refrigeration cycle while defrosting one low temperature load. By maintaining this 3:1 ratio of loads in a refrigeration cycle to loads in a defrost cycle, there is sufficient refrigerant available to defrost a load.

It may not always be possible however to maintain this ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

This disclosure contemplates a cooling system that can perform hot gas defrost even when the system may not be operating a sufficient number of loads in a refrigeration cycle. To supply additional refrigerant for a defrost cycle, the cooling system uses a subcooler heat exchanger that supplies additional refrigerant to a low temperature compressor. In some embodiments, the subcooler heat exchanger uses refrigerant stored in a flash tank to subcool refrigerant from a high side heat exchanger. The subcooler heat exchanger then directs the now heated refrigerant from the flash tank to the low temperature compressor. In other embodiments, the subcooler heat exchanger directs refrigerant stored in the flash tank to an expansion valve. The subcooler heat exchanger then uses the refrigerant from the expansion valve to subcool refrigerant from the flash tank. The subcooler heat exchanger directs the now heated refrigerant from the expansion valve to the low temperature compressor. Certain embodiments of the cooling system are described below.

According to an embodiment, an apparatus includes a high side heat exchanger, a subcooler heat exchanger, a flash tank, a first load, and a first compressor. The high side heat exchanger removes heat from a refrigerant. The subcooler heat exchanger receives the refrigerant from the high side heat exchanger. The flash tank stores the refrigerant from the subcooler heat exchanger. During a first mode of operation, the first load configured uses the refrigerant from the flash tank to cool a first space proximate the first load and the first compressor compresses the refrigerant from the first load. During a second mode of operation, the subcooler heat exchanger receives the refrigerant from the flash tank, transfers heat from the refrigerant from the high side heat exchanger to the refrigerant from the flash tank and directs the refrigerant from the flash tank to the first compressor. During the second mode of operation, the first compressor compresses the refrigerant from the subcooler heat exchanger and directs the compressed refrigerant from the subcooler heat exchanger to the first load to defrost the first load.

According to another embodiment, a method includes removing, by a high side heat exchanger, heat from a refrigerant and receiving, by a subcooler heat exchanger, the refrigerant from the high side heat exchanger. The method also includes storing, by a flash tank, the refrigerant from the subcooler heat exchanger. During a first mode of operation, the method includes using, by a first load, the refrigerant from the flash tank to cool a first space proximate the first load and compressing, by a first compressor, the refrigerant from the first load. During a second mode of operation, the method includes receiving, by the subcooler heat exchanger, the refrigerant from the flash tank, transferring, by the subcooler heat exchanger, heat from the refrigerant from the high side heat exchanger to the refrigerant from the flash tank, directing, by the subcooler heat exchanger, the refrigerant from the flash tank to the first compressor, compressing, by the first compressor, the refrigerant from the subcooler heat exchanger, and directing, by the first compressor, the compressed refrigerant from the subcooler heat exchanger to the first load to defrost the first load.

According to yet another embodiment, a system includes a high side heat exchanger, a subcooler heat exchanger, a flash tank, a first load, a second load, a first compressor, and a second compressor. The high side heat exchanger removes heat from a refrigerant. The subcooler heat exchanger receives the refrigerant from the high side heat exchanger. The flash tank stores the refrigerant from the subcooler heat exchanger. During a first mode of operation, the first load uses the refrigerant from the flash tank to cool a first space proximate the first load and the second load uses the refrigerant form the flash tank to cool a second space proximate the second load. During the first mode of operation, the first compressor compresses the refrigerant from the first load and the second compressor compresses a mixture of the refrigerant from the first compressor and the refrigerant from the second load. During a second mode of operation, the subcooler heat exchanger receives the refrigerant from the flash tank, transfers heat from the refrigerant from the high side heat exchanger to the refrigerant from the flash tank and directs the refrigerant from the flash tank to the first compressor. During the second mode of operation, the first compressor compresses the refrigerant from the subcooler heat exchanger and directs the compressed refrigerant from the subcooler heat exchanger to the first load to defrost the first load.

According to an embodiment, an apparatus includes a high side heat exchanger, a flash tank, a subcooler, an expansion valve, a first load, and a first compressor. The high side heat exchanger removes heat from a refrigerant. The flash tank stores the refrigerant from the high side heat exchanger. The subcooler heat exchanger receives the refrigerant from the flash tank. During a first mode of operation, the first load uses the refrigerant from the flash tank to cool a first space proximate the first load and the first compressor compresses the refrigerant from the first load. During a second mode of operation, the subcooler heat exchanger directs the refrigerant from the flash tank to the expansion valve, transfers heat from the refrigerant from the flash tank to the refrigerant from the expansion valve and directs the refrigerant from the expansion valve to the first compressor. During the second mode of operation, the first compressor compresses the refrigerant from the subcooler heat exchanger and directs the compressed refrigerant from the subcooler heat exchanger to the first load to defrost the first load.

According to another embodiment, a method includes removing, by a high side heat exchanger, heat from a refrigerant, storing, by a flash tank, the refrigerant from the high side heat exchanger, and receiving, by a subcooler heat exchanger, the refrigerant from the flash tank. During a first mode of operation, the method includes using, by a first load, the refrigerant from the flash tank to cool a first space proximate the first load and compressing, by a first compressor, the refrigerant from the first load. During a second mode of operation, the method includes directing, by the subcooler heat exchanger, the refrigerant from the flash tank to the expansion valve, transferring, by the subcooler heat exchanger, heat from the refrigerant from the flash tank to the refrigerant from the expansion valve, directing, by the subcooler heat exchanger, the refrigerant from the expansion valve to the first compressor, compressing, by the first compressor, the refrigerant from the subcooler heat exchanger, and directing, by the first compressor, the compressed refrigerant from the subcooler heat exchanger to the first load to defrost the first load.

According to yet another embodiment, a system includes a high side heat exchanger, a flash tank, a subcooler heat exchanger, an expansion valve, a first load, a second load, a first compressor, and a second compressor. The high side heat exchanger removes heat from a refrigerant. The flash tank stores the refrigerant from the high side heat exchanger. The subcooler heat exchanger receives the refrigerant from the flash tank. During a first mode of operation, the first load uses the refrigerant from the flash tank to cool a first space proximate the first load, the second load uses the refrigerant form the flash tank to cool a second space proximate the second load, the first compressor compresses the refrigerant from the first load, and the second compressor compresses a mixture of the refrigerant from the first compressor and the refrigerant from the second load. During a second mode of operation, the subcooler heat exchanger directs the refrigerant from the flash tank to the expansion valve, transfers heat from the refrigerant from the flash tank to the refrigerant from the expansion valve and directs the refrigerant from the expansion valve to the first compressor. During the second mode of operation, the first compressor compresses the refrigerant from the subcooler heat exchanger and directs the compressed refrigerant from the subcooler heat exchanger to the first load to defrost the first load.

Certain embodiments may provide one or more technical advantages. For example, an embodiment allows for sufficient refrigerant to be available to perform a defrost cycle even though there may not be sufficient loads in the system are not operating at full capacity or frequently. As another example, an embodiment allows for faster defrost of a load by supplying additional refrigerant for defrost. As yet another example, an embodiment reduces energy consumption of medium temperature load compressors. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
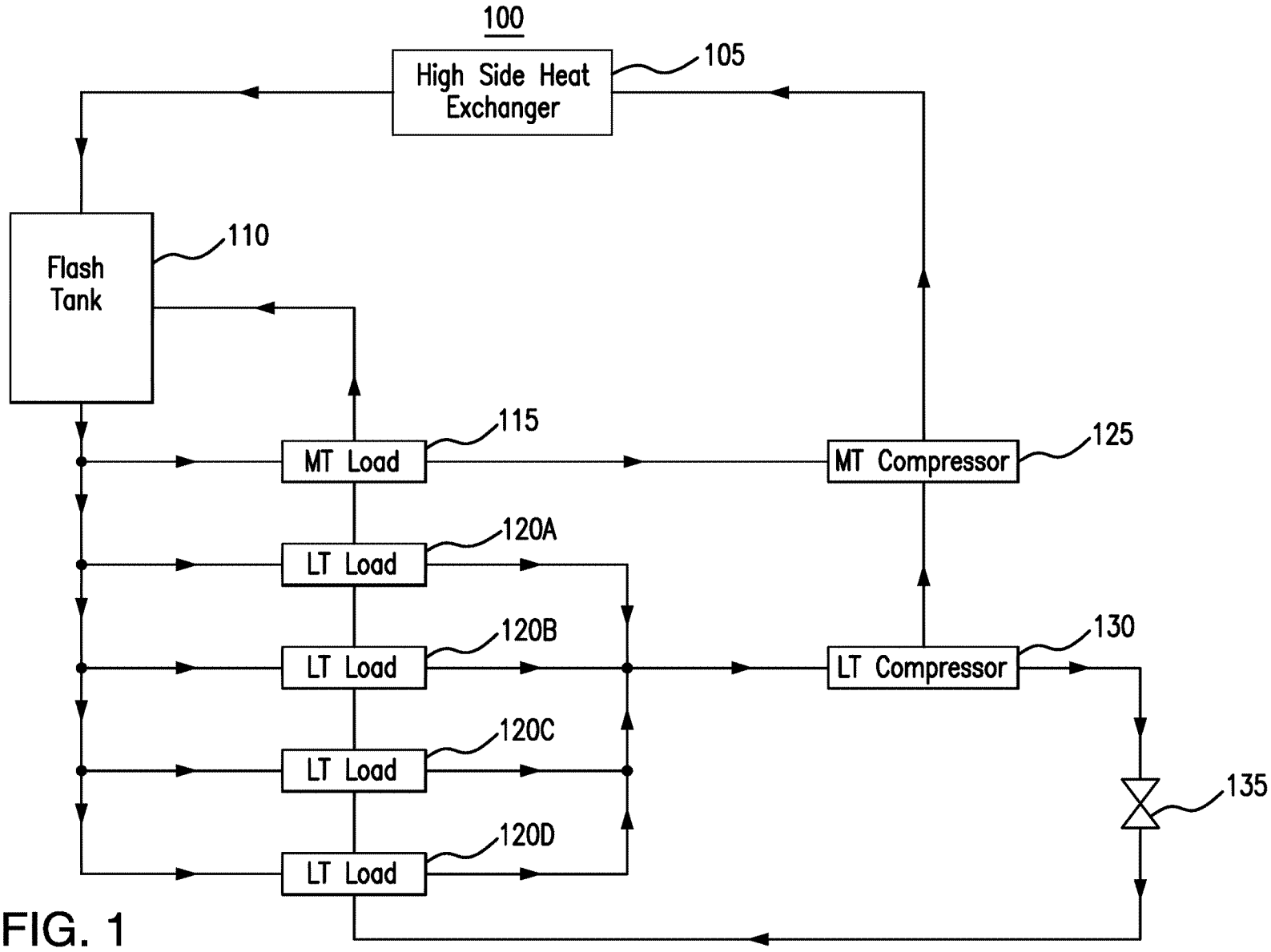
FIG. 1 illustrates an example cooling system.

Embodiments of the present disclosure and its advantages are best understood by referring to FIGS. 1 through 7 of the drawings, like numerals being used for like and corresponding parts of the various drawings.

Cooling systems cycle refrigerant to cool various spaces. For example, a refrigeration system cycles refrigerant to cool spaces near or around refrigeration loads. These loads include metal components, such as coils, that carry the refrigerant. As the refrigerant passes through these metallic components, frost and/or ice may accumulate on the exterior of these metallic components. The ice and/or frost reduce the efficiency of the load. For example, as frost and/or ice accumulates on a load, it may become more difficult for the refrigerant within the load to absorb heat that is external to the load. Typically, the ice and frost accumulate on loads in a low temperature section of the system (e.g., freezer cases).

In existing systems, one way to address frost and/or ice accumulation on the load is to cycle refrigerant back to the load after the refrigerant has absorbed heat from the load. Usually, discharge from a low temperature compressor is cycled back to a low temperature load to defrost that load. In this manner, the heated refrigerant passes over the frost and/or ice accumulation and defrosts the load. This process of cycling hot refrigerant over frosted and/or iced loads is known as hot gas defrost. Existing cooling systems that have a hot gas defrost cycle typically maintain three low temperature loads in a refrigeration cycle while defrosting one low temperature load. By maintaining this 3:1 ratio of loads in a refrigeration cycle to loads in a defrost cycle, there is sufficient refrigerant available to defrost a load.

It may not always be possible however to maintain this ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

This disclosure contemplates a cooling system that can perform hot gas defrost even when the system may not be operating a sufficient number of loads in a refrigeration cycle. To supply additional refrigerant for a defrost cycle, the cooling system uses a subcooler heat exchanger that supplies additional refrigerant to a low temperature compressor. In some embodiments, the subcooler heat exchanger uses refrigerant stored in a flash tank to subcool refrigerant from a high side heat exchanger. The subcooler heat exchanger then directs the now heated refrigerant from the flash tank to the low temperature compressor. In other embodiments, the subcooler heat exchanger directs refrigerant stored in the flash tank to an expansion valve. The subcooler heat exchanger then uses the refrigerant from the expansion valve to subcool refrigerant from the flash tank. The subcooler heat exchanger directs the now heated refrigerant from the expansion valve to the low temperature compressor.

In certain embodiments, the cooling system allows for sufficient refrigerant to be available to perform a defrost cycle even though there may not be sufficient loads in the system are not operating at full capacity or frequently. In some embodiments, the cooling system allows for faster defrost of a load by supplying additional refrigerant for defrost. In particular embodiments, the cooling system reduces energy consumption of medium temperature load compressors. The cooling system will be described using FIGS. 1 through 7. FIG. 1 will describe an existing cooling system with hot gas defrost. FIGS. 2 through 7 describe the cooling system with improved hot gas defrost.

FIG. 1 illustrates an example cooling system 100. As shown in FIG. 1, system 100 includes a high side heat exchanger 105, a flash tank 110, a medium temperature load 115, low temperature loads 120A-120D, a medium temperature compressor 125, a low temperature compressor 130, and a valve 135. By operating valve 135, system 100 allows for hot gas to be circulated to a low temperature load 120 to defrost low temperature load 120. After defrosting low temperature load 120, the hot gas and/or refrigerant is cycled back to flash tank 110.

High side heat exchanger 105 removes heat from a refrigerant. When heat is removed from the refrigerant, the refrigerant is cooled. This disclosure contemplates high side heat exchanger 105 being operated as a condenser and/or a gas cooler. When operating as a condenser, high side heat exchanger 105 cools the refrigerant such that the state of the refrigerant changes from a gas to a liquid. When operating as a gas cooler, high side heat exchanger 105 cools gaseous refrigerant and the refrigerant remains a gas. In certain configurations, high side heat exchanger 105 is positioned such that heat removed from the refrigerant may be discharged into the air. For example, high side heat exchanger 105 may be positioned on a rooftop so that heat removed from the refrigerant may be discharged into the air. As another example, high side heat exchanger 105 may be positioned external to a building and/or on the side of a building. This disclosure contemplates any suitable refrigerant (e.g., carbon dioxide) being used in any of the disclosed cooling systems.

Flash tank 110 stores refrigerant received from high side heat exchanger 105. This disclosure contemplates flash tank 110 storing refrigerant in any state such as, for example, a liquid state and/or a gaseous state. Refrigerant leaving flash tank 110 is fed to low temperature loads 120A-120D and medium temperature load 115. In some embodiments, a flash gas and/or a gaseous refrigerant is released from flash tank 110. By releasing flash gas, the pressure within flash tank 110 may be reduced. System 100 includes a low temperature portion and a medium temperature portion. The low temperature portion operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. Refrigerant flows from flash tank 110 to both the low temperature and medium temperature portions of the refrigeration system. For example, the refrigerant flows to low temperature loads 120A-120D and medium temperature load 115. When the refrigerant reaches low temperature loads 120A-120D or medium temperature load 115, the refrigerant removes heat from the air around low temperature loads 120A-120D or medium temperature load 115. As a result, the air is cooled. The cooled air may then be circulated such as, for example, by a fan to cool a space such as, for example, a freezer and/or a refrigerated shelf. As refrigerant passes through low temperature loads 120A-120D and medium temperature load 115, the refrigerant may change from a liquid state to a gaseous state as it absorbs heat. This disclosure contemplates including any number of low temperature loads 120 And medium temperature loads 115 in any of the disclosed cooling systems.

The refrigerant cools metallic components of low temperature loads 120A-120D and medium temperature load 115 as the refrigerant passes through low temperature loads 120A-120D and medium temperature load 115. For example, metallic coils, plates, parts of low temperature loads 120A-120D and medium temperature load 115 may cool as the refrigerant passes through them. These components may become so cold that vapor in the air external to these components condenses and eventually freeze or frost onto these components. As the ice or frost accumulates on these metallic components, it may become more difficult for the refrigerant in these components to absorb heat from the air external to these components. In essence, the frost and ice acts as a thermal barrier. As a result, the efficiency of cooling system 100 decreases the more ice and frost that accumulates. Cooling system 100 may use heated refrigerant to defrost these metallic components.

Refrigerant flows from low temperature loads 120A-D and medium temperature load 115 to compressors 125 and 130. This disclosure contemplates the disclosed cooling systems including any number of low temperature compressors 130 and medium temperature compressors 125. Both the low temperature compressor 130 and medium temperature compressor 125 compress refrigerant to increase the pressure of the refrigerant. As a result, the heat in the refrigerant may become concentrated and the refrigerant may become a high-pressure gas. Low temperature compressor 130 compresses refrigerant from low temperature loads 120A-120D and sends the compressed refrigerant to medium temperature compressor 125. Medium temperature compressor 125 compresses a mixture of the refrigerant from low temperature compressor 130 and medium temperature load 115. Medium temperature compressor 125 then sends the compressed refrigerant to high side heat exchanger 105.

Valve 135 may be opened or closed to cycle refrigerant from low temperature compressor 130 back to a low temperature load 120. The refrigerant may be heated after absorbing heat from the other low temperature loads 120 And being compressed by low temperature compressor 130. The hot refrigerant and/or hot gas is then cycled over the metallic components of the low temperature load 120 to defrost it. Afterwards, the hot gas and/or refrigerant is cycled back to flash tank 110. There may be additional valves between low temperature compressor 130 and low temperature loads 120A-D that control to which load 120A-D is defrosted by the refrigerant coming from low temperature compressor 130. This process of cycling heated refrigerant over a low temperature load 120 to defrost it is referred to as a defrost cycle.

In existing installations, for there to be sufficient refrigerant to defrost a load (e.g., low temperature load 120A), there may be three times as many operating loads as there are loads that need defrosting. In the illustrated example of FIG. 1, heated refrigerant from three loads, 120B-D, may be used to defrost low temperature load 120A. It may not always be possible however to maintain this 3:1 ratio. For example, there may be times (e.g., at night or when a store is closed) when the system and the loads are running less frequently or less strenuously, thus resulting in less refrigerant being available to defrost a load. As another example, because each load occupies space, some stores may not have enough space available to install four or more loads. In these installations, there may not be sufficient refrigerant available to defrost even one load.

This disclosure contemplates a cooling system that can perform hot gas defrost without necessarily operating three times as many loads as defrosting loads. Generally, this cooling system uses a subcooler that uses refrigerant from the flash tank to subcool refrigerant going to the flash tank or in the flash tank. The heated refrigerant is then directed to a low temperature compressor to supply to a load for defrost. In this manner, the low temperature compressor is provided supplemental refrigerant and it is possible to perform a defrost cycle even though there are not three times as many operating loads as there are defrosting loads in certain embodiments.

Figure 2:
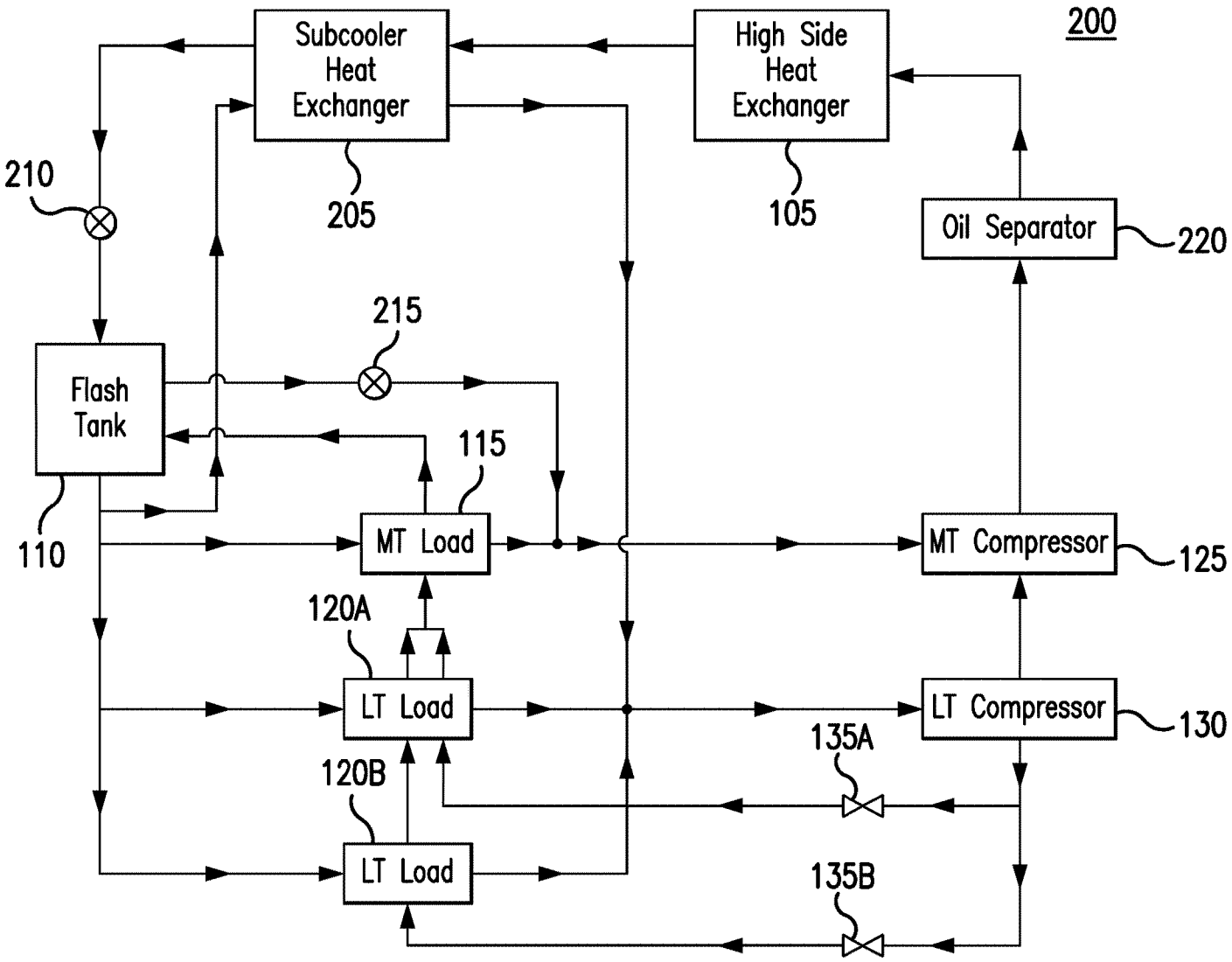
FIG. 2 illustrates an example cooling system.
Figure 3:
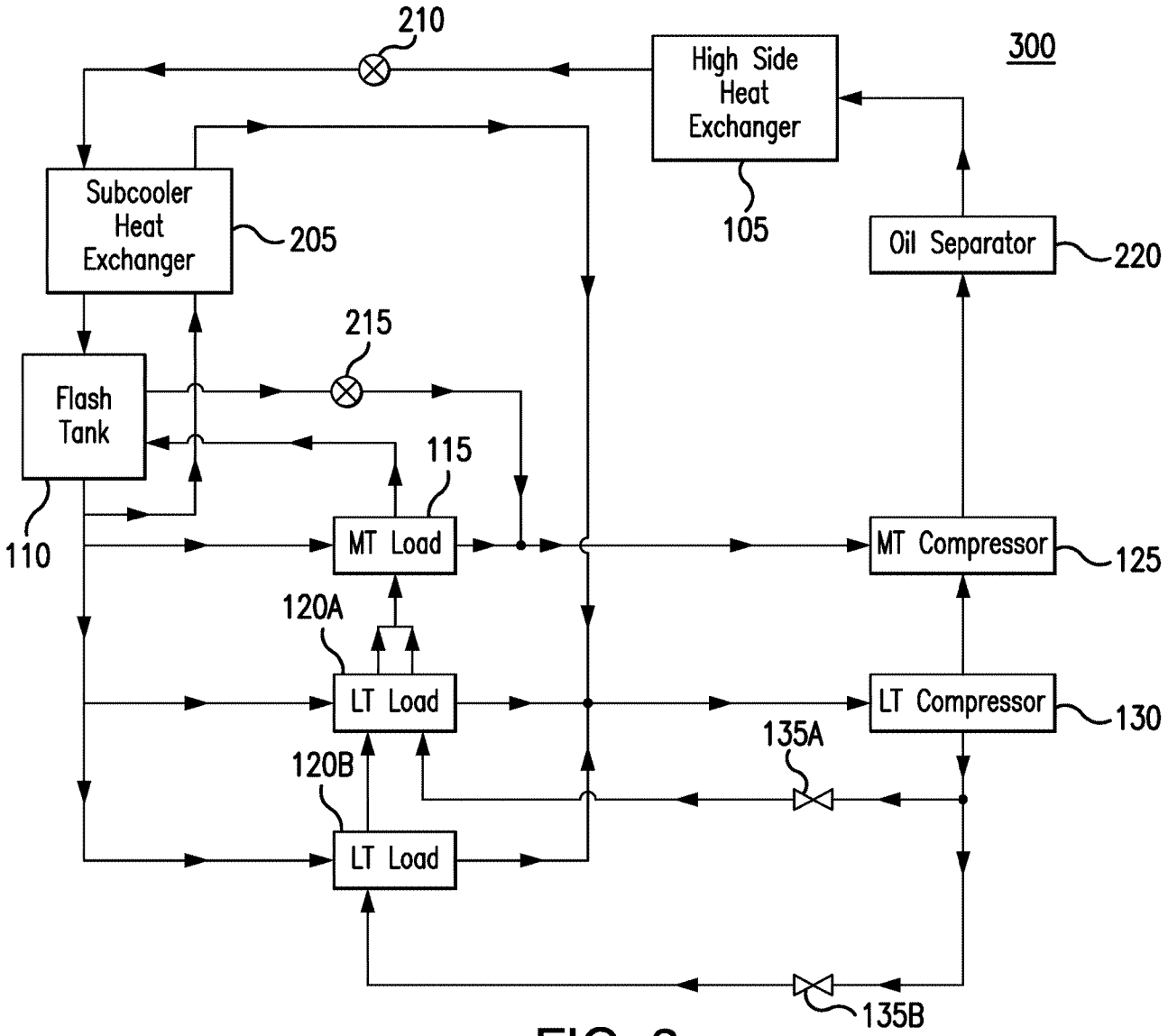
FIG. 3 illustrates an example cooling system.
Figure 4:
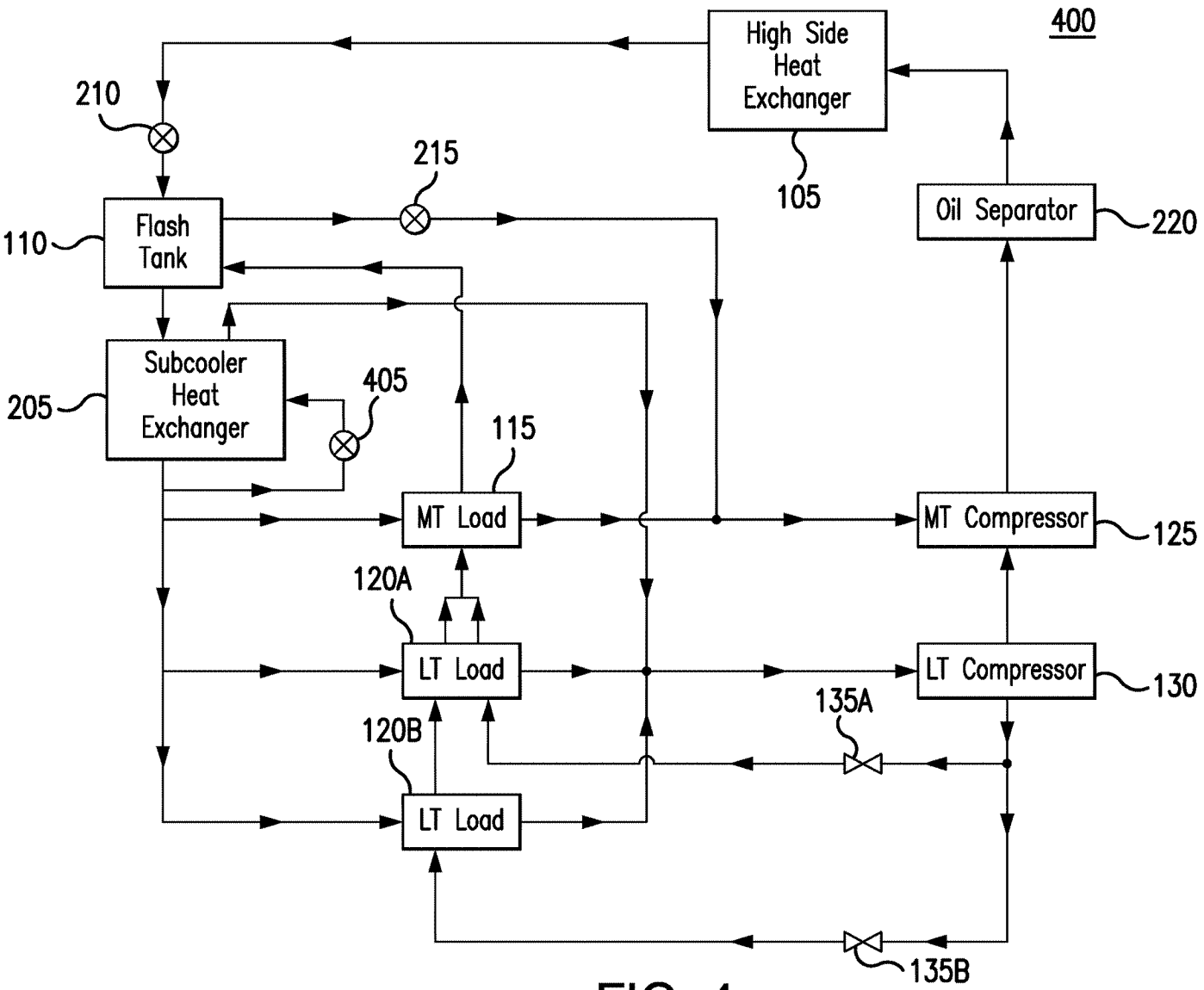
FIG. 4 illustrates an example cooling system.
Figure 5:
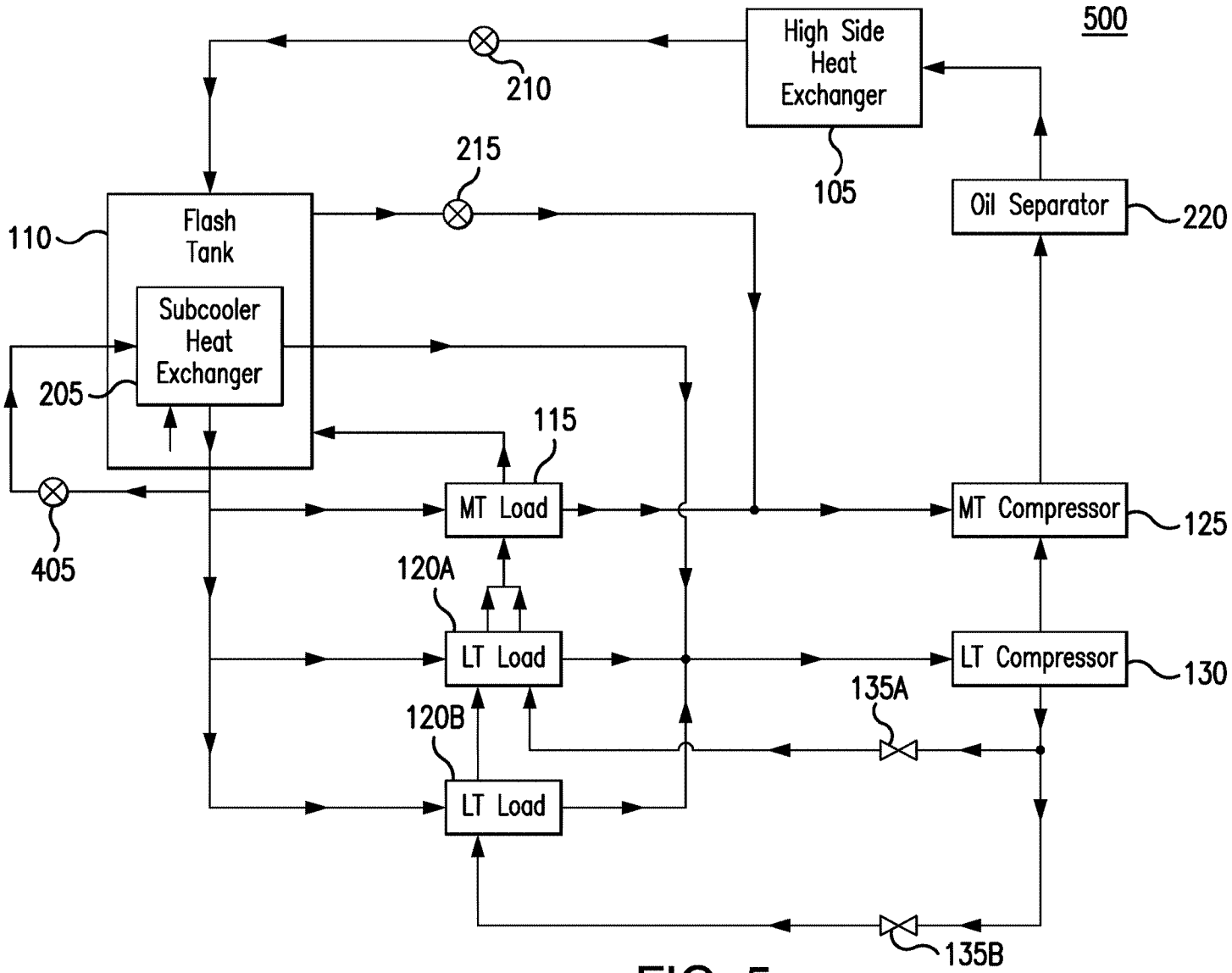
FIG. 5 illustrates an example cooling system.
Figure 6:
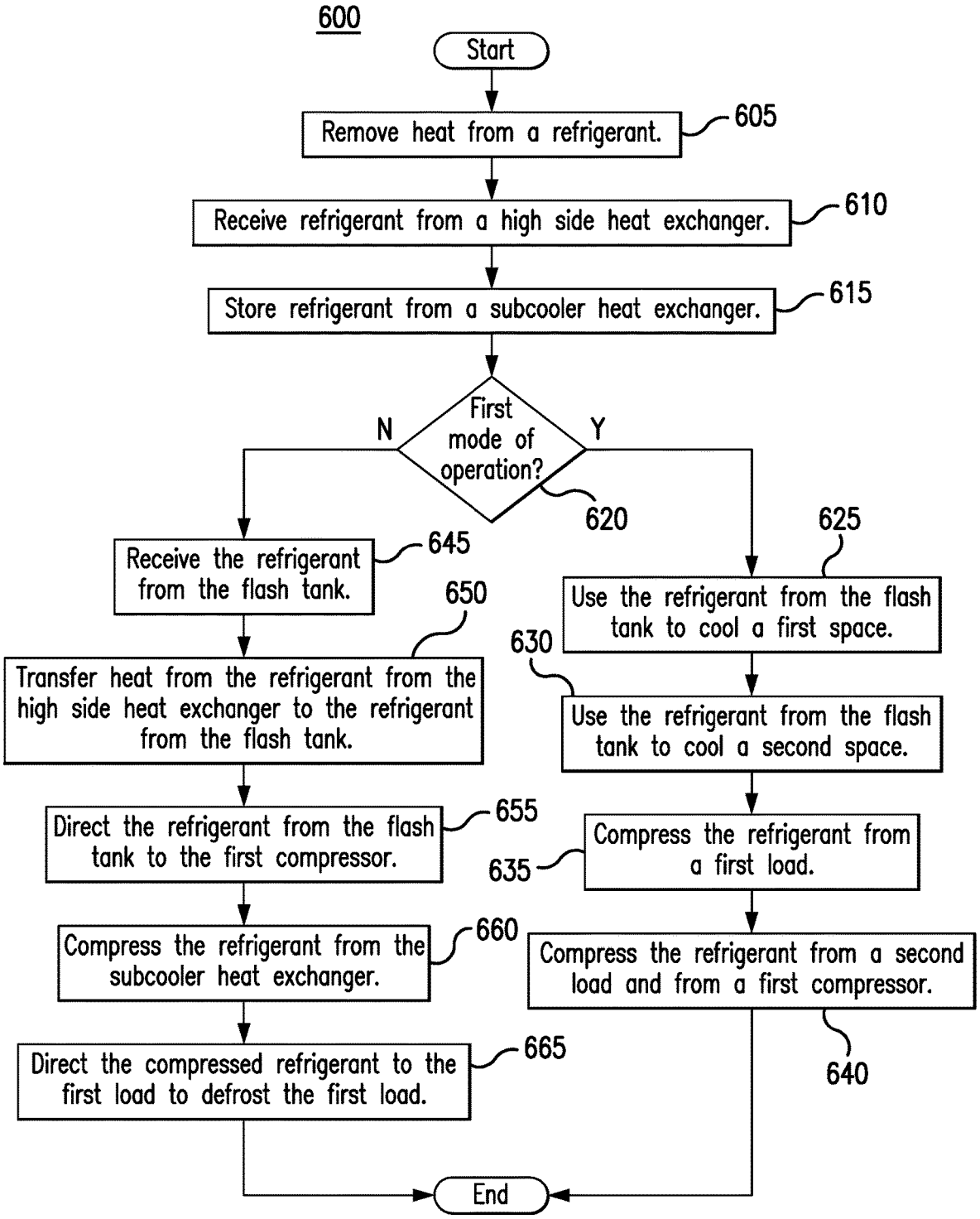
FIG. 6 is a flowchart illustrating a method of operating an example cooling system.
Figure 7:
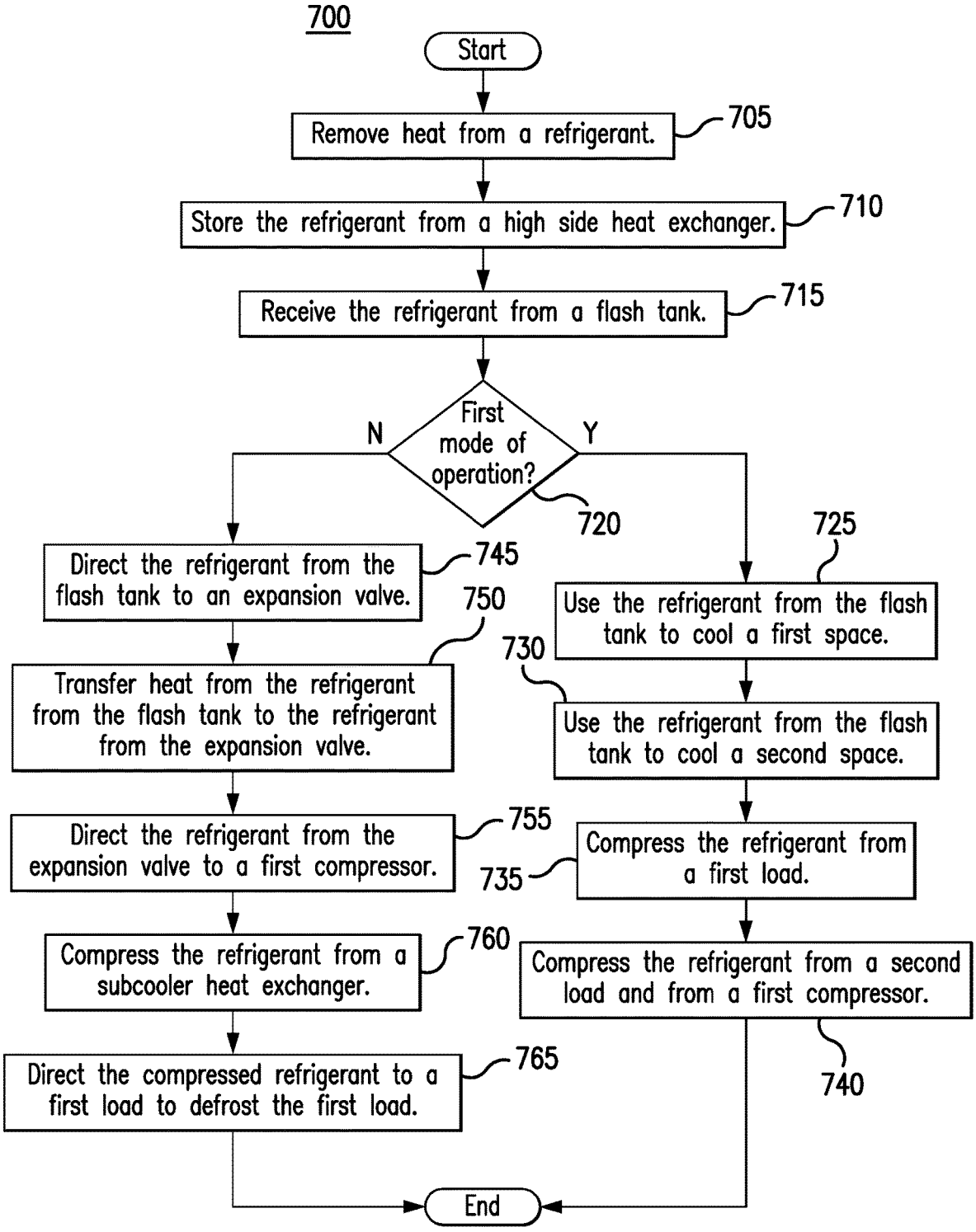
FIG. 7 is a flowchart illustrating a method of operating an example cooling system.

Embodiments of the cooling system are described below using FIGS. 2-7. These figures illustrate embodiments that include a certain number of loads and compressors for clarity and readability. However, this disclosure contemplates these embodiments including any suitable number of loads and compressors. Generally, FIGS. 2 and 3 illustrate embodiments where a subcooler heat exchanger is included between a high side heat exchanger and a flash tank, and FIGS. 4 and 5 illustrate embodiments where a subcooler heat exchanger is included between a flash tank and a load. FIGS. 6 and 7 illustrate example methods of operating these systems.

FIG. 2 illustrates an example cooling system 200. As see in FIG. 2, system 200 includes a high side heat exchanger 105, a subcooler heat exchanger 205, an expansion valve 210, a flash tank 110, a medium temperature load 115, low temperature loads 120A and 120B, medium temperature compressor 125, low temperature compressor 130, valves 135A and 135B, valve 215, and an oil separator 220. Generally, subcooler heat exchanger 205 provides additional refrigerant to low temperature compressor 130 during a defrost cycle. In this manner, there will be sufficient refrigerant to defrost a low temperature load 120, even though the other low temperature loads 120 in system 200 do not provide enough refrigerant to perform the defrost cycle.

High side heat exchanger 105, flash tank 110, medium temperature load 115, low temperature loads 120A and 120B, medium temperature compressor 125, low temperature compressor 130, and valves 135A and 135B operate similarly in system 200 as they did in system 100. For example, high side heat exchanger 105 removes heat from a refrigerant. Flash tank 110 stores a refrigerant. During a normal refrigeration cycle, or a first mode of operation, medium temperature load 115 and low temperature loads 120A and 120B use the refrigerant from flash tank 110 to absorb heat from a space approximate those loads. The loads then send the refrigerant to their corresponding compressors. Medium temperature load 115 directs refrigerant to medium temperature compressor 125. Low temperature loads 120A and 120B direct refrigerant to low temperature compressor 130. Low temperature compressor 130 compresses the refrigerant from low temperature loads 120A and 120B. Medium temperature compressor 125 compresses the refrigerant from medium temperature load 115 and low temperature compressor 130.

During a defrost cycle, or a second mode of operation, refrigerant from low temperature compressor 130 is directed back to a low temperature load 120 through a valve 135 to defrost the load 120. For example, low temperature load 120A may be shut off. Then, refrigerant from low temperature compressor 130 is directed through valve 135A back to low temperature load 120A. That refrigerant defrosts low temperature load 120A and is directed back to flash tank 110. A similar operation may be performed for low temperature load 120B. In some installations, there may not be enough loads operating in the system to supply sufficient refrigerant to perform a defrost cycle. System 200 addresses this issue by supplying additional refrigerant through subcooler heat exchanger 205 to low temperature compressor 130.

Subcooler heat exchanger 205 receives refrigerant from high side heat exchanger 105. Subcooler heat exchanger 205 then directs that refrigerant to flash tank 110 through expansion valve 210. During a normal cycle, that refrigerant is then provided to medium temperature load 115 and/or low temperature loads 120A and 120B to cool spaces proximate those loads. During a defrost cycle, subcooler heat exchanger 205 receives refrigerant from flash tank 110. Subcooler heat exchanger 205 then transfers heat from the refrigerant from high side heat exchanger 105 to the refrigerant from flash tank 110. As a result, the refrigerant from high side heat exchanger 105 is subcooled before reaching flash tank 110, which improves the efficiency of cooling system 200 in certain embodiments. Subcooler heat exchanger 205 then directs the heated refrigerant from flash tank 110 to low temperature compressor 130. This heated refrigerant is then used by low temperature compressor 130 as additional refrigerant for the defrost cycle. In this manner, system 200 supplies additional refrigerant to low temperature compressor 130 during a defrost cycle.

Subcooler heat exchanger 205 may be operational during the defrost cycle, but not during a normal refrigeration cycle. In other words, subcooler heat exchanger 205 may be operational for different modes of operations of system 200. In this manner, subcooler heat exchanger 205 provides refrigerant to low temperature compressor 130, only when that additional refrigerant is needed in certain embodiments.

Expansion valve 210 controls a flow of refrigerant. For example, when expansion valve 210 is opened, refrigerant flows through expansion valve 210. When expansion valve 210 is closed, refrigerant stops flowing through expansion valve 210. In certain embodiments, expansion valve 210 can be opened to varying degrees to adjust the amount of flow of refrigerant. For example, expansion valve 210 may be opened more to increase the flow of refrigerant. As another example, expansion valve 210 may be opened less to decrease the flow of refrigerant. Thus, expansion valve 210 directs refrigerant from subcooler heat exchanger 205 to flash tank 110.

Expansion valve 210 is used to cool refrigerant flowing through expansion valve 210. Expansion valve 210 may receive refrigerant from any component of system 200 such as for example high side heat exchanger 105 and/or subcooler heat exchanger 205. Expansion valve 210 reduces the pressure and therefore the temperature of the refrigerant. Expansion valve 210 reduces pressure from the refrigerant flowing into the expansion valve 210. The temperature of the refrigerant may then drop as pressure is reduced. As a result, refrigerant entering expansion valve 210 may be cooler when leaving expansion valve 210.

The refrigerant that is used to defrost a low temperature load 120 is directed back to flash tank 110. That refrigerant is then directed from flash tank 110 to medium temperature compressor 125 through valve 215, along with flash gas from flash tank 110. Valve 215 controls the flow of refrigerant. Valve 215 may be opened to allow refrigerant (e.g., flash gas) to flow through valve 215. Valve 215 may be closed to stop refrigerant from flowing through valve 215. In certain embodiments, valve 215 can be opened to varying degrees to adjust the amount of flow of refrigerant. For example, valve 215 may be opened more to increase the flow of refrigerant. As another example, valve 215 may be opened less to decrease the flow of refrigerant. In certain embodiments, refrigerant used to defrost a load 120 flows through flash tank 110 and then through valve 215 to medium temperature compressor 125. Flash gas from flash tank 110 also flows through valve 215 to medium temperature compressor 125.

Oil separator 220 receives refrigerant from medium temperature compressor 125. Oil separator 220 separates oil that may have mixed with the refrigerant. The oil may have mixed with the refrigerant in low temperature compressor 130 and/or medium temperature compressor 125. By separating the oil from the refrigerant, oil separator 220 protects other components of system 100 from being clogged and/or damaged by the oil. Oil separator 220 may collect the separated oil. The oil may then be removed from oil separator 220 and added back to low temperature compressor 130 and/or medium temperature compressor 125. Certain embodiments do not include oil separator 220. In these embodiments, refrigerant from medium temperature compressor 125 flows directly to high side heat exchanger 105.

In some embodiments, low temperature loads 120A and 120B are operational during a normal refrigeration cycle. Then, during a defrost cycle, a low temperature load 120 that is being defrosted is shut off, while a low temperature load 120 that is not being defrosted remains operational. For example, if low temperature load 120A is being defrosted, then low temperature load 120B may remain operational during the defrost cycle to supply refrigerant to low temperature compressor 130 to defrost low temperature load 120A. Subcooler heat exchanger 205 may supply additional refrigerant that low temperature compressor 130 uses to defrost low temperature load 120A.

An example operation of system 200 is as follows. High side heat exchanger 105 removes heat from a refrigerant and directs that refrigerant to subcooler heat exchanger 205. During a normal refrigeration cycle, subcooler heat exchange 205 directs the refrigerant from high side heat exchanger 105 to expansion valve 210. Expansion valve 210 lowers the temperature of the refrigerant from subcooler heat exchanger 205 and directs refrigerant into flash tank 110. Flash tank 110 stores the refrigerant from the expansion valve 210. Flash tank 110 directs refrigerant to medium temperature load 115 and low temperature loads 120A and 120B. Medium temperature load 115 and low temperature loads 120A and 120B use the refrigerant from flash tank 110 to cool spaces proximate those loads. Medium temperature load 115 directs refrigerant to medium temperature compressor 125. Low temperature loads 120A and 120B direct refrigerant to low temperature compressor 130. During the normal refrigeration cycle, valves 135A and 135B are closed so low temperature compressor 130 does not direct refrigerant back to low temperature loads 120A and 120B to defrost those loads. Low temperature compressor 130 compresses the refrigerant from low temperature loads 120A and 120B and directs the refrigerant to medium temperature compressor 125. Medium temperature compressor 125 compresses refrigerant from medium temperature load 115 and low temperature compressor 130 and directs that refrigerant to oil separator 220. Oil separator 220 removes oil from the refrigerant and directs the refrigerant to high side heat exchanger 105.

During a defrost cycle, subcooler heat exchanger 205 receives additional refrigerant from flash tank 110. Subcooler heat exchanger 205 transfers heat from the refrigerant from high side heat exchanger 105 to the refrigerant from flash tank 110. As a result, the refrigerant from high side heat exchanger 105 is subcooled, and the refrigerant from flash tank 110 is heated. Subcooler heat exchanger 205 directs the heated refrigerant from flash tank 110 to low temperature compressor 130. Low temperature compressor 130 compresses the refrigerant from subcooler heat exchanger 205 and the refrigerant from many operational low temperature loads 120. Low temperature compressor 130 directs refrigerant through one or more of valves 135A and 135B to one or more low temperature loads 120A and 120B to defrost those loads 120A and 120B. After the refrigerant defrosts those loads, the refrigerant is directed to flash tank 110. Flash tank 110 then discharges that refrigerant along with flash gas through valve 215 to medium temperature compressor 125. Medium temperature compressor 125 compresses that refrigerant and the refrigerant from medium temperature load 115 and directs that refrigerant to oil separator 220.

FIG. 3 illustrates an example cooling system 300. As show in FIG. 3, cooling system 300 includes a high side heat exchanger 105, a flash tank 110, a medium temperature load 115, low temperature loads 120A and 120B, medium temperature compressor 125, low temperature compressor 130, valves 135A and 135B, a subcooler heat exchanger 205, an expansion valve 210, a valve 215, and an oil separator 220. Generally, subcooler heat exchanger 205 supplies additional refrigerant to low temperature compressor 130 during the defrost cycle so that there is enough refrigerant to perform the defrost cycle.

High side heat exchanger 105, flash tank 110, medium temperature load 115, low temperature loads 120A and 120B, medium temperature compressor 125, low temperature compressor 130, and valves 135A and 135B operate similarly as they did in system 100. For example, high side heat exchanger 105 removes heat from a refrigerant. Flash tank 110 stores the refrigerant. Medium temperature load 115 and low temperature loads 120A and 120B use the refrigerant from flash tank 110 to cool spaces proximate those loads during a normal refrigeration cycle. Medium temperature compressor 125 compresses the refrigerant from medium temperature load 115 and from low temperature compressor 130. Low temperature compressor 130 compresses the refrigerant from low temperature loads 120A and 120B. During a defrost cycle, low temperature compressor 130 directs refrigerant back to one or more of low temperature loads 120A and 120B through one or more of valves 135A and 135B to defrost one or more of low temperature loads 120A and 120B.

Subcooler heat exchanger 205, expansion valve 210, valve 215, and oil separator 220 operate similarly as they did in system 200. For example, subcooler heat exchanger 205 directs refrigerant from high side heat exchanger 105 to flash tank 110. During a defrost cycle, subcooler heat exchanger 205 receives refrigerant from flash tank 110 and directs that refrigerant to low temperature compressor 130. Additionally, subcooler heat exchanger 205 transfers heat from the refrigerant from high side heat exchanger 105, to the refrigerant from flash tank 110. The difference between system 300 and system 200, is the position of subcooler heat exchanger 205. As seen in FIG. 3, subcooler heat exchanger 205 is positioned between high side heat exchanger 105 and flash tank 110 after expansion valve 210. As a result, expansion valve 210 directs refrigerant from high side heat exchanger 105 to subcooler heat exchanger 205. The refrigerant received by subcooler heat exchanger 205 is at a lower pressure than the refrigerant received by subcooler heat exchanger 205 in system 200.

In particular embodiments, by using subcooler heat exchanger 205, additional refrigerant is supplied to low temperature compressor 130 from flash tank 110 during a defrost cycle. Additionally, during the defrost cycle the refrigerant received by flash tank 110 is subcooled by subcooler heat exchanger 205, which improves the efficiency of systems 200 and 300. The additional refrigerant supplied to low temperature compressor 130 allows the defrost cycle to be performed, even when there is not enough refrigerant provided by the low temperature loads 120 to low temperature compressor 130.

An example operation of system 300 is as follows. High side heat exchanger 105 removes heat from a refrigerant and directs that refrigerant to expansion valve 210. Expansion valve 210 reduces the temperature of the refrigerant from high side heat exchanger 105 and directs the refrigerant to subcooler heat exchanger 205. Subcooler heat exchanger 205 then directs that refrigerant to flash tank 110. Flash tank 110 stores the refrigerant from subcooler heat exchanger 205. During a normal refrigeration cycle, flash tank 110 directs refrigerant to medium temperature load 115 and low temperature loads 120A and 120B. Medium temperature load 115 and low temperature loads 120A and 120B use the refrigerant from flash tank 110 to cool spaces proximate those loads. Medium temperature load 115 directs the refrigerant to medium temperature compressor 125. Low temperature loads 120A and 120B direct the refrigerant to low temperature compressor 130. Low temperature compressor 130 compresses the refrigerant from low temperature loads 120A and 120B. Because, valves 135A and 135B are closed during the normal refrigeration cycle, low temperature compressor 130 directs the refrigerant to medium temperature compressor 125. Medium temperature compressor 125 compresses the refrigerant from medium temperature load 115 and low temperature compressor 130 and directs that refrigerant to oil separator 220. Oil separator 220, removes oil from the refrigerant and directs the refrigerant to high side heat exchanger 105.

During a defrost cycle, flash tank 110 directs refrigerant to medium temperature load 115 and any operational low temperature loads 120. Medium temperature load 115 and operational low temperature loads 120 use the refrigerant to cool spaces proximate to those loads. Medium temperature load 115 directs refrigerant to medium temperature compressor 125. Operational low temperature loads 120 direct refrigerant to low temperature compressor 130. Additionally, flash tank 110 directs refrigerant to subcooler heat exchanger 205. Subcooler heat exchanger 205 transfers heat from the refrigerant from expansion valve 210 and high side heat exchanger 105 to the refrigerant from flash tank 110. As a result, the refrigerant from expansion valve 210 and high side heat exchanger 105 is subcooled and the refrigerant from flash tank 110 is heated. Subcooler heat exchanger 205 directs the subcooled refrigerant to flash tank 110 and the heated refrigerant to low temperature compressor 130. The heated refrigerant is then used by low temperature compressor 130 as additional refrigerant to defrost any low temperature loads 120 that have been shut off for defrost. Low temperature compressor 130 receives refrigerant from any operational low temperature loads 120 and sub cooler heat exchanger 205. Low temperature compressor 130 then directs the refrigerant through one more of valves 135A and 135B to one or more of low temperature loads 120A and 120B to defrost those loads. The refrigerant used to defrost those loads is then directed to flash tank 110. Flash tank 110 discharges that refrigerant along with flash gas through valve 215 to medium temperature compressor 125. Medium temperature compressor 125 compresses the refrigerant from medium temperature load 115 and flash tank 110. Medium temperature compressor 125 then directs the refrigerant to oil separator 220.

FIG. 4 illustrates an example cooling system 400. As shown in FIG. 4, system 400 includes a high side heat exchanger 105, a flash tank 110, a medium temperature load 115, low temperature loads 120A and 120B, a medium temperature compressor 125, a low temperature compressor 130, valves 135A and 135B, a subcooler heat exchanger 205, an expansion valve 210, a valve 215, an oil separator 220, and an expansion valve 405. Generally, subcooler heat exchanger 205 directs refrigerant to low temperature compressor 130 during a defrost cycle to supply additional refrigerant to defrost a low temperature load 120.

High side heat exchanger 105, flash tank 110, medium temperature load 115, low temperature loads 120A and 120B, medium temperature compressor 125, low temperature compressor 130, and valves 135A and 135B operate similarly as they did in system 100. For example, high side heat exchanger 105 removes heat from a refrigerant. Flash tank 110 stores the refrigerant. Medium temperature load 115 and low temperature loads 120A and 120B use the refrigerant to cool spaces proximate those loads during a normal refrigeration cycle. Medium temperature compressor 125 compresses refrigerant from medium temperature load 115 and low temperature compressor 130. Low temperature compressor 130 compresses refrigerant from low temperature loads 120A and 120B. During a defrost cycle, low temperature compressor 130 directs refrigerant back to one or more of low temperature loads 120A and 120B through one or more of valves 135A or 135B to defrost one or more of loads 120A and 120B.

Subcooler heat exchanger 205, expansion valve 210, valve 215, and oil separator 220 operate similarly as they did in system 200. The difference between system 400 and system 200 is the configuration of sub cooler heat exchanger 205. In system 400, subcooler heat exchanger 205 is positioned between flash tank 110 and medium temperature load 115 and low temperature loads 120A and 120B. During a normal refrigeration cycle, subcooler heat exchanger 205 receives refrigerant from flash tank 110. Subcooler heat exchanger 205 then directs that refrigerant to medium temperature load 115 and low temperature loads 120A and 120B. The refrigerant is used by medium temperature load 115 and low temperature loads 120A and 120B to cool the spaces proximate those loads. Expansion valve 405 is closed during the normal refrigeration cycle.

During the defrost cycle, expansion valve 405 opens to allow refrigerant to flow through valve 405 back to subcooler heat exchanger 205. In this manner, a portion of the refrigerant from flash tank 110 flows through subcooler heat exchanger 205 and valve 405, and back through subcooler heat exchanger 205. Subcooler heat exchanger 205 transfers heat from the refrigerant from flash tank 110 to the refrigerant from valve 405. As a result, the refrigerant from flash tank 110 is subcooled and the refrigerant from valve 405 is heated. Subcooler heat exchanger 205 then directs the subcooled refrigerant to medium temperature load 115 and low temperature loads 120A and 120B. Subcooler heat exchanger 205 also directs the heated refrigerant from valve 405 to low temperature compressor 130. As a result, the heated refrigerant is supplied as additional refrigerant for the defrost cycle.

In particular embodiments, subcooler heat exchanger 205 supplies additional refrigerant to low temperature compressor 130, so that low temperature 130 can successfully defrost low temperature load 120A and low temperature load 120B. The refrigerant used to defrost the low temperature load 120 is directed back to flash tank 110. That refrigerant is then discharged from flash tank 110 along with flash gas through valve 215 to medium temperature compressor 125.

Thermal expansion valve 405 controls a flow of refrigerant. For example, when expansion valve 405 is opened, refrigerant flows through expansion valve 405. When expansion valve 405 is closed, refrigerant stops flowing through expansion valve 405. In certain embodiments, expansion valve 405 can be opened to varying degrees to adjust the amount of flow of refrigerant. For example, expansion valve 405 may be opened more to increase the flow of refrigerant. As another example, expansion valve 405 may be opened less to decrease the flow of refrigerant. Thus, expansion valve 405 directs refrigerant from subcooler heat exchanger 205 back to subcooler heat exchanger 205.

Expansion valve 405 is used to cool refrigerant flowing through expansion valve 405. Expansion valve 405 may receive refrigerant from subcooler heat exchanger 205. Expansion valve 405 reduces the pressure and therefore the temperature of the refrigerant. Expansion valve 405 reduces pressure from the refrigerant flowing into the expansion valve 405. The temperature of the refrigerant may then drop as pressure is reduced. As a result, refrigerant entering expansion valve 405 may be cooler when leaving expansion valve 405.

An example operation of system 400 is as follows, high side heat exchanger 105 removes heat from a refrigerant and directs that refrigerant to valve 210. Valve 210 reduces the temperature of that refrigerant and directs the refrigerant to flash tank 110. Flash tank 110 stores the refrigerant and directs the refrigerant to subcooler heat exchanger 205. During a normal refrigeration cycle, subcooler heat exchanger 205 directs the refrigerant to medium temperature load 115, low temperature load 120A, and low temperature load 120B. Valve 405 is closed so the refrigerant does not flow back to subcooler heat exchanger 205. Medium temperature load 115, low temperature load 120A, and low temperature load 120B use the refrigerant to cool spaces proximate those loads. The refrigerant from low temperature loads 120A and 120B is directed to low temperature compressor 130. The refrigerant from medium temperature load 115 is directed to medium temperature compressor 125. Low temperature compressor 130 compresses the refrigerant from low temperature loads 120A and 120B and directs that refrigerant to medium temperature compressor 125. Valves 135A and 135B are closed so low temperature compressor 130 does not direct refrigerant back to low temperature loads 120A or 120B. Medium temperature compressor 125 compresses the refrigerant from medium temperature load 115 and low temperature compressor 130 and directs the refrigerant to oil separator 220. Oil separator 220 separates oil from the refrigerant and directs the refrigerant back to high side heat exchanger 105.

During a defrost cycle, valve 405 opens and one or more of valves 135A and 135B open. Also, one or more of low temperature loads 120A and 120B shut off for defrost. During the defrost cycle, subcooler heat exchanger directs some refrigerant to valve 405. Valve 405 cools that refrigerant and directs that refrigerant back to subcooler heat exchanger 205. Subcooler heat exchanger 205 transfers heat from the refrigerant from flash tank 110 to the refrigerant from valve 405. In this manner, the refrigerant from flash tank 110 is sub cooled and the refrigerant from valve 405 is heated. Subcooler heat exchanger 205 then directs the sub cooled refrigerant to medium temperature load 115 and any operational low temperature loads 120A or 120B. Medium temperature load 115 and operational low temperature loads 120 use the subcooled refrigerant to cool spaces proximate those loads. Medium temperature load 115 then directs the refrigerant to medium temperature compressor 125. Operational low temperature loads 120 direct the refrigerant to low temperature compressor 130. Additionally, subcooler heat exchanger 205 directs the heated refrigerant from valve 405 to low temperature compressor 130. Because, one or more of valves 135A and 135B are open, low temperature compressor 130 directs refrigerant through the open valve 135 to a low temperature load 120 that is shut off for defrost. The refrigerant defrosts the load 120. The refrigerant is then directed to flash tank 110. Flash tank 110 discharges that refrigerant along with flash gas through valve 215 to medium temperature compressor 125. Medium temperature compressor 125 compresses the refrigerant from medium temperature load 115 along with the refrigerant from flash tank 110 and the flash gas and directs that compressed mixture to oil separator 220.

FIG. 5, illustrates an example cooling system 500. As seen in FIG. 5, system 500 includes a high side heat exchanger 105, a flash tank 110, a medium temperature load 115, low temperature loads 120A and 120B, medium temperature compressor 125, low temperature compressor 130, valves 135A and 135B, a subcooler heat exchanger 205, an expansion valve 215, an oil separator 220, and a valve 405. Generally, subcooler heat exchanger 205 supplies additional refrigerant to low temperature compressor 130 during a defrost cycle so that low temperature compressor 130 has sufficient refrigerant to perform the defrost.

High side heat exchanger 105, flash tank 110, medium temperature load 115, low temperature load 120A and 120B, medium temperature compressor 125, low temperature compressor 130, and valves 135A and 135B operate similarly as they did in system 100. For example, high side heat exchanger 105 removes heat from a refrigerant. Flash tank 110 stores that the refrigerant. Medium temperature load 115 and low temperature loads 120A and 120B use the refrigerant from flash tank 110 to cool spaces proximate those loads. Low temperature compressor 130 compresses the refrigerant from low temperature loads 120A and 120B and directs the refrigerant to medium temperature compressor 125 during a normal refrigeration cycle. Medium temperature compressor 125 compresses the refrigerant from medium temperature load 115 and low temperature compressor 130 and directs the refrigerant to oil separator 220. Valves 135A and 135B open and close depending on if system 500 is in a normal refrigeration cycle or a defrost cycle.

Subcooler heat exchanger 205 is positioned within flash tank 110 and supplies additional refrigerant to low temperature compressor 130 during a defrost cycle. Subcooler heat exchanger 205 receives refrigerant stored within flash tank 110 and directs that refrigerant to medium temperature load 115 and low temperature loads 120A and 120B. During a defrost cycle, subcooler heat exchanger 205 directs refrigerant though valve 405 back to subcooler heat exchanger 205. Similar to valve 405 in system 400, valve 405 in system 500 cools the refrigerant flowing through valve 405. Subcooler heat exchanger 205 then transfers heat from the refrigerant from flash tank 110 to the refrigerant from valve 405. As a result, the refrigerant from flash tank 110 is subcooled and the refrigerant from valve 405 is heated. Subcooler heat exchanger 205 then directs the subcooled refrigerant to medium temperature load 115 and any operational loads 120. Subcooler heat exchanger 205 directs the heated refrigerant to low temperature compressor 130 to supply additional refrigerant for the defrost.

During a defrost cycle, low temperature compressor 130 receives refrigerant from any operational low temperature loads 120 and from subcooler heat exchanger 205. Low temperature compressor 130 directs the refrigerant through one or more of valves 135A and 135B to any shut off low temperature loads 120A and 120B to defrost those loads. The refrigerant used to defrost those loads is then directed back to flash tank 110. Flash tank 110 discharges that refrigerant along with flash gas through valve 215 to medium temperature compressor 125. In this manner, subcooler heat exchanger 205 supplies additional refrigerant to low temperature compressor 130 so that low temperature compressor 130 has sufficient refrigerant to preform hot gas defrost.

An example operation of system 500 is as follows. High side heat exchanger 105 removes heat from a refrigerant and directs that refrigerant to expansion valve 210. Valve 210 reduces the temperature of that refrigerant and directs that refrigerant to flash tank 110. Flash tank 110 stores the refrigerant and directs the refrigerant to subcooler heat exchanger 205. During a regular refrigeration cycle, subcooler heat exchanger 205 directs the refrigerant to medium temperature load 115 and low temperature loads 120A and 120B. Medium temperature load 115 and low temperature loads 120A and 120B use that refrigerant to cool spaces proximate to those loads. Medium temperature load 115 directs the refrigerant to medium temperature compressor 125. Low temperature loads 120A and 120B direct the refrigerant to low temperature compressor 130. Low temperature compressor 130 then compress the refrigerant from low temperature loads 120 And 120B. Because valves 135A and 135B are closed during a normal refrigeration cycle, low temperature compressor 130 directs refrigerant to medium temperature compressor 125. Medium temperature compressor 125 compress refrigerant from medium temperature load 115 and low temperature compressor 130 and directs the refrigerant to oil separator 220. Oil separator 220 removes oil from the refrigerant and directs the refrigerant to high side heat exchanger 105.

During a defrost cycle, subcooler heat exchanger 205 directs the refrigerant to medium temperature load 115 and any operational loads 120. Subcooler heat exchanger 205 also directs refrigerant through valve 405 back to subcooler heat exchanger 205. Subcooler heat exchanger 205 transfers heat from the refrigerant from flash tank 110 to the refrigerant from valve 405. As a result, the refrigerant from flash tank 110 is subcooled and the refrigerant from valve 405 is heated. Subcooler heat exchanger 205 directs the subcooled refrigerant to medium temperature load 115 and any operational low temperature loads 120A and 120B. Subcooler heat exchanger 205 directs the heated refrigerant to low temperature compressor 130. Medium temperature load 115 and any operational low temperature loads 120 use the refrigerant from subcooler heat exchanger 205 to cool spaces proximate those loads. Medium temperature load 115 directs the refrigerant to medium temperature compressor 125. Operational low temperature loads 120 direct the refrigerant to low temperature compressor 130. Low temperature compressor 130 compresses the refrigerant from any operational loads 120 and subcooler heat exchanger 205. Low temperature compressor 130 then direct the refrigerant through one or more valves 135A and 135B to defrost one or more of low temperature loads 120A and 120B. After the refrigerant has defrosted low temperature loads 120A and 120B, the refrigerant is directed to flash tank 110. Flash tank 110 discharges that refrigerant along with flash gas through valve 215 to medium temperature compressor 125. Medium temperature compressor 125 compress the refrigerant from medium temperature load 115 and flash tank 110 and directs the refrigerant to oil separator 220.

In particular embodiments, sub cooler heat exchanger 205 improves system efficiency by sub cooling the refrigerant that is supplied to loads during a defrost cycle. Additionally, subcooler heat exchanger 205 allows the defrost cycle to perform successfully by supplying additional refrigerant to a low temperature compressor in certain embodiments. As a result, a cooling system is able to perform a defrost cycle successfully.

FIG. 6 is a flow chart illustrating a method 600 of operating an example cooling system. Various components of systems 200 and/or 300 preform the steps of method 600 in particular embodiments. By preforming method 600, additional refrigerant can be supplied to perform a defrost cycle.

Method 600 begins with a high side heat exchanger removing heat from a refrigerant in step 605. In step 610, a subcooler heat exchanger receives refrigerant from the high side heat exchanger. A flash tank stores refrigerant from the subcooler heat exchanger in step 615. In step 620, a processor or controller determines whether the system should be in a first mode of operation, such as for example a normal refrigeration cycle. If the system should be in a first mode of operation, then a medium temperature load uses the refrigerant from the flash tank to cool a first space in step 625. In step 630, a low temperature load uses the refrigerant from the flash tank to cool a second space. In step 635, a low temperature compressor compresses the refrigerant from a first load, such as the low temperature load. A medium temperature compressor compresses the refrigerant from a second load, such as the medium temperature load and from a first compressor, such as the low temperature compressor in step 640.

If the system is not in a first mode of operation, then it may be determined that the system should be running in a second mode of operation, such as, for example a defrost cycle. In step 645, the subcooler heat exchanger receives the refrigerant from the flash tank. In step 650, the subcooler heat exchanger transfers heat from the refrigerant from the high side heat exchanger to the refrigerant from the flash tank. The subcooler heat exchanger then directs the refrigerant from the flash tank to the first compressor, such as the low temperature compressor, in step 655. The low temperature compressor then compresses the refrigerant from the subcooler heat exchanger in step 660. In step 665, the low temperature compressor directs the compressed refrigerant to the first load, such as a first temperature load, to defrost the first load. In this manner, the subcooler heat exchanger supplies additional refrigerant to the low temperature compressor during a defrost cycle so that the first load, such as the low temperature load, may be defrosted by the additional refrigerant.

FIG. 7 is a flow chart illustrating a method 700 of operating an example cooling system. Various components of systems 400 and/or 500 preform the steps of method 700 in certain embodiments. By performing method 700, the system supplies additional refrigerant for a hot gas defrost cycle.

Method 700 begins with a high side heat exchanger removing heat from a refrigerant in step 705. In step 710, a flash tank stores the refrigerant from the high side heat exchanger. A subcooler heat exchanger receives the refrigerant from the flash tank in step 715. In step 720, a processor or controller determines whether the cooling system should be in a first mode of operation, such as for example a normal refrigeration cycle. If it is determined that the system should be in a normal refrigeration cycle, a medium temperature load uses the refrigerant from the flash tank to cool a first space in step 725. In step 730, a low temperature load uses the refrigerant from the flash tank to cool a second space. A low temperature compressor compresses the refrigerant from a first load, such as the low temperature load, in step 735. In step 740, a medium temperature compressor compresses the refrigerant from a second load, such as the medium temperature load and from a first compressor, such as the low temperature compressor.

If it is determined that the cooling system is not or should not be in the first mode of operation, then it may be determined that the cooling system should be in the second mode of operation, such as for example a defrost cycle. If the cooling system should be in a defrost cycle, then the subcooler heat exchanger directs the refrigerant from the flash tank to an expansion valve in step 745. In step 750, the subcooler heat exchanger transfers heat from the refrigerant from the flash tank to the refrigerant from the expansion valve. The subcooler heat exchanger then directs the refrigerant from the expansion valve to a first compressor, such as the low temperature compressor in step 755. In step 760, the low temperature compressor compresses the refrigerant from the subcooler heat exchanger. The low temperature compressor then directs the compressed refrigerant to a first load, such as a low temperature load, to defrost low temperature load in step 765. In this manner the subcooler heat exchanger supplies additional refrigerant to a low temperature compressor to perform a defrost cycle.

Modifications, additions, or omissions may be made to methods 600 and 700 depicted in FIGS. 6 and 7. Methods 600 and 700 may include more, fewer, or other steps. For example, steps may be performed in parallel or in any suitable order. While discussed as systems 200, 300, 400, and/or 500 (or components thereof) performing the steps, any suitable component of systems 200, 300, 400, and/or 500 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

This disclosure may refer to a refrigerant being from a particular component of a system (e.g., the refrigerant from the medium temperature compressor, the refrigerant from the low temperature compressor, the refrigerant from the flash tank, etc.). When such terminology is used, this disclosure is not limiting the described refrigerant to being directly from the particular component. This disclosure contemplates refrigerant being from a particular component (e.g., the high side heat exchanger) even though there may be other intervening components between the particular component and the destination of the refrigerant. For example, the subcooler heat exchanger receives a refrigerant from the high side heat exchanger even though there is an expansion valve between the high side heat exchanger and the subcooler heat exchanger.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a high side heat exchanger configured to remove heat from a refrigerant;

a subcooler heat exchanger configured to receive the refrigerant from the high side heat exchanger;

a flash tank configured to store the refrigerant from the subcooler heat exchanger;

a first load; and a first compressor fluidly coupled to the first load;

during a first mode of operation:

the first load configured to use the refrigerant from the flash tank to cool a first space proximate the first load;

the first compressor configured to compress the refrigerant from the first load; and during a second mode of operation:

the subcooler heat exchanger is positioned between the flash tank and the first compressor, and configured to:

receive the refrigerant from the flash tank;

transfer heat from the refrigerant from the high side heat exchanger to the refrigerant from the flash tank; and direct the refrigerant from the flash tank to the first compressor;

the first compressor configured to:

compress the refrigerant from the subcooler heat exchanger; and direct the compressed refrigerant from the subcooler heat exchanger to the first load to defrost the first load;

a second load configured to use the refrigerant from the flash tank to cool a second space proximate the second load during the first mode of operation; and a second compressor configured to compress a mixture of the refrigerant from the second load and the refrigerant from the first compressor during the first mode of operation.

2. The apparatus of claim 1, further comprising an expansion valve configured to direct the refrigerant from the subcooler heat exchanger to the flash tank.

3. The apparatus of claim 1, further comprising an expansion valve configured to direct the refrigerant from the high side heat exchanger to the subcooler heat exchanger.

4. The apparatus of claim 1, wherein during the second mode of operation:

the first load is configured to direct the compressed refrigerant from the first compressor to the flash tank; and the flash tank is configured to direct the compressed refrigerant from the first load to the ft second compressor.

5. The apparatus of claim 1, further comprising an oil separator configured to separate an oil from the refrigerant from the second compressor.

6. The apparatus of claim 1, wherein the flash tank is further configured to direct a flash gas to the second compressor.

7. A method comprising:

removing, by a high side heat exchanger, heat from a refrigerant;

receiving, by a subcooler heat exchanger, the refrigerant from the high side heat exchanger;

storing, by a flash tank, the refrigerant from the subcooler heat exchanger;

during a first mode of operation:

using, by a first load, the refrigerant from the flash tank to cool a first space proximate the first load;

compressing, by a first compressor that is fluidly coupled to the first load, the refrigerant from the first load; and during a second mode of operation:

receiving, by the subcooler heat exchanger, the refrigerant from the flash tank;

transferring, by the subcooler heat exchanger, heat from the refrigerant from the high side heat exchanger to the refrigerant from the flash tank;

directing, by the subcooler heat exchanger that is positioned between the flash tank and the first compressor, the refrigerant from the flash tank to the first compressor;

compressing, by the first compressor, the refrigerant from the subcooler heat exchanger;

directing, by the first compressor, the compressed refrigerant from the subcooler heat exchanger to the first load to defrost the first load;

using, by a second load, the refrigerant from the flash tank to cool a second space proximate the second load during the first mode of operation; and compressing, by a second compressor, a mixture of the refrigerant from the second load and the refrigerant from the first compressor during the first mode of operation.

8. The method of claim 7, further comprising directing, by an expansion valve, the refrigerant from the subcooler heat exchanger to the flash tank.

9. The method of claim 7, further comprising directing, by an expansion valve, the refrigerant from the high side heat exchanger to the subcooler heat exchanger.

10. The method of claim 7, further comprising, during the second mode of operation:

directing, by the first load, the compressed refrigerant from the first compressor to the flash tank; and directing, by the flash tank, the compressed refrigerant from the first load to the second compressor.

11. The method of claim 7, further comprising separating, by an oil separator, an oil from the refrigerant from the second compressor.

12. The method of claim 7, further comprising directing, by the flash tank, a flash gas to the second compressor.

13. A system comprising:

a high side heat exchanger configured to remove heat from a refrigerant;

a subcooler heat exchanger configured to receive the refrigerant from the high side heat exchanger;

a flash tank configured to store the refrigerant from the subcooler heat exchanger;

a first load;

a second load;

a first compressor; and a second compressor;

during a first mode of operation:

the first load configured to use the refrigerant from the flash tank to cool a first space proximate the first load;

the second load configured to use the refrigerant form the flash tank to cool a second space proximate the second load;

the first compressor configured to compress the refrigerant from the first load; and the second compressor configured to compress a mixture of the refrigerant from the first compressor and the refrigerant from the second load; and during a second mode of operation:

the subcooler heat exchanger configured to:

receive the refrigerant from the flash tank;

transfer heat from the refrigerant from the high side heat exchanger to the refrigerant from the flash tank; and direct the refrigerant from the flash tank to the first compressor;

the first compressor configured to:

compress the refrigerant from the subcooler heat exchanger; and direct the compressed refrigerant from the subcooler heat exchanger to the first load to defrost the first load.

14. The system of claim 13, further comprising an expansion valve configured to direct the refrigerant from the subcooler heat exchanger to the flash tank.

15. The system of claim 13, further comprising an expansion valve configured to direct the refrigerant from the high side heat exchanger to the subcooler heat exchanger.

16. The system of claim 13, wherein during the second mode of operation:

the first load is configured to direct the compressed refrigerant from the first compressor to the flash tank; and the flash tank is configured to direct the compressed refrigerant from the first load to the second compressor.

17. The system of claim 13, further comprising an oil separator configured to separate an oil from the refrigerant from the second compressor.

18. The system of claim 13, wherein the flash tank is further configured to direct a flash gas to the second compressor.

* * * * *